US010466650B1

(12) United States Patent
Brown

(10) Patent No.: US 10,466,650 B1
(45) Date of Patent: Nov. 5, 2019

(54) "WEDGE IN PLACE" WATCH ATTACHMENT

(71) Applicant: Peter Brown, Haverhill, MA (US)

(72) Inventor: Peter Brown, Haverhill, MA (US)

( * ) Notice: Subject to any disclaimer, the term of this patent is extended or adjusted under 35 U.S.C. 154(b) by 0 days.

(21) Appl. No.: 16/197,794

(22) Filed: Nov. 21, 2018

Related U.S. Application Data

(60) Provisional application No. 62/711,078, filed on Jul. 27, 2018.

(51) Int. Cl.
*A44C 5/00* (2006.01)
*G04B 37/14* (2006.01)

(52) U.S. Cl.
CPC ..... *G04B 37/14* (2013.01); *A44C 5/0053* (2013.01)

(58) Field of Classification Search
CPC ..... A44C 5/00; A44C 5/0053; G04B 37/005; G04B 47/00; G04B 37/1486
USPC ..... 224/171, 152, 164, 165, 166, 167, 168, 224/169, 170, 172, 173, 174, 175, 178, 224/179
See application file for complete search history.

(56) References Cited

U.S. PATENT DOCUMENTS 2,184,060 A * 12/1939 Singer ..... A44C 5/0053 224/171
6,499,875 B1 * 12/2002 Telly ..... G04B 37/005 224/171
8,870,448 B2 * 10/2014 Bianco ..... A44C 5/00 224/174
2009/0135681 A1 * 5/2009 Lawson ..... A44C 5/00 368/282

* cited by examiner

*Primary Examiner* — Adam J Waggenspack
(74) *Attorney, Agent, or Firm* — Law Offices of Daniel A. Tessler, LLC

(57) ABSTRACT

The present invention is a selectively attachable watch accessory for filling the gap between a watch and/or wristband and a wearer's wrist. The watch accessory also keeps a watch from rotating or sliding along a wearer's wrist without making the wristband unusually tight and also can change the angle of the watch display. The watch accessory can include a wedge pad, a removable bridge strap and a removable wedge pin that secures the accessory to a watch and/or a wristband. The watch accessory allows a user to fill a gap between a watch and/or wristband and a wearer's wrist that is present on many watches to enhance the fit of a watch. This device is useful for traditional watches and smart watches that encourage a user to interact much more with a limb mounted screen.

18 Claims, 7 Drawing Sheets

"WEDGE IN PLACE" WATCH ATTACHMENT

CROSS REFERENCE TO RELATED APPLICATIONS

This application claims the benefit of U.S. Provisional Patent Application No. 62/711,078 filed Jul. 27, 2018, which is hereby incorporated by reference in its entirety.

FIELD OF THE INVENTION

The present invention relates to watch accessories, in particular, to a selectively attachable watch accessory configured to fill a gap that forms between a watch and/or wristband and a wearer's wrist.

BACKGROUND OF THE INVENTION

Watches are commonly worn on the wrist and secured using a wristband or a bracelet. Watches are often loose on a person's wrist and capable of both unwanted rotation relative to a person's wrist and unwanted displacement along a person's wrist. While wristbands or bracelets can be adjusted to suit a person's wrist size, because of the size increments provided for a given wristband or bracelet, a person often must choose between a watch that is uncomfortably loose or tight.

BRIEF SUMMARY OF THE INVENTION

The present invention provides a selectively attachable watch accessory for filling a gap that forms between a watch and/or wristband and a wearer's wrist. The present invention can also prevent a watch, when worn on a limb, from rotating or sliding relative to a person's limb. The invention can also allow a wearer to change the angle of a watch display. The present invention is referred to herein as the "wedge in place" or "WIP" attachment or device because of its position when installed on a watch between the watch and/or wristband and the person's wrist. While the device is referred to as a WIP, it does not necessarily need to be wedged in all instances and can merely be placed in the installed position without any significant pressure exerted on any surface.

The WIP can comprise a wedge pad 11, a bridge strap 12 and a wedge pin 13.

The wedge pad can comprise a hypoallergenic rubber and a generally triangular profile. The bridge strap can be configured to attach the wedge pad to the wristband or watch.

The term "wristband," as used herein, refers to any type of device used to secure a wrist-watch to a person's limb. A wristband can include, for example, a strap, a bracelet or a chain. The wedge pin is configured to selectively attach the bridge strap to the wedge pad. While a wedge pin is shown as a possible embodiment, it is appreciated that other suitable mechanisms known in the art could be substituted for the wedge pin.

The WIP can be worn under the side of a wristwatch further away from a wearer's face so that the WIP fills the gap between the watch and wearer's wrist, stops the watch from rotating or sliding along a wearer's wrist without discomfort and increases the angle of the watch face to a more suitable angle for viewing by the wearer. As used herein, the terms "wristwatch" and "watch" refer to any device designed to be worn on a person's limb. Devices designed to be worn on a person's limb can include, for example, watches, wristwatches, smart watches, smart phones, calculators and other electronic devices.

DETAILED DESCRIPTION OF THE INVENTION

The invention will be illustrated in more detail with reference to the following embodiments, but it should be understood that the present invention is not deemed to be limited thereto.

Figure 1:
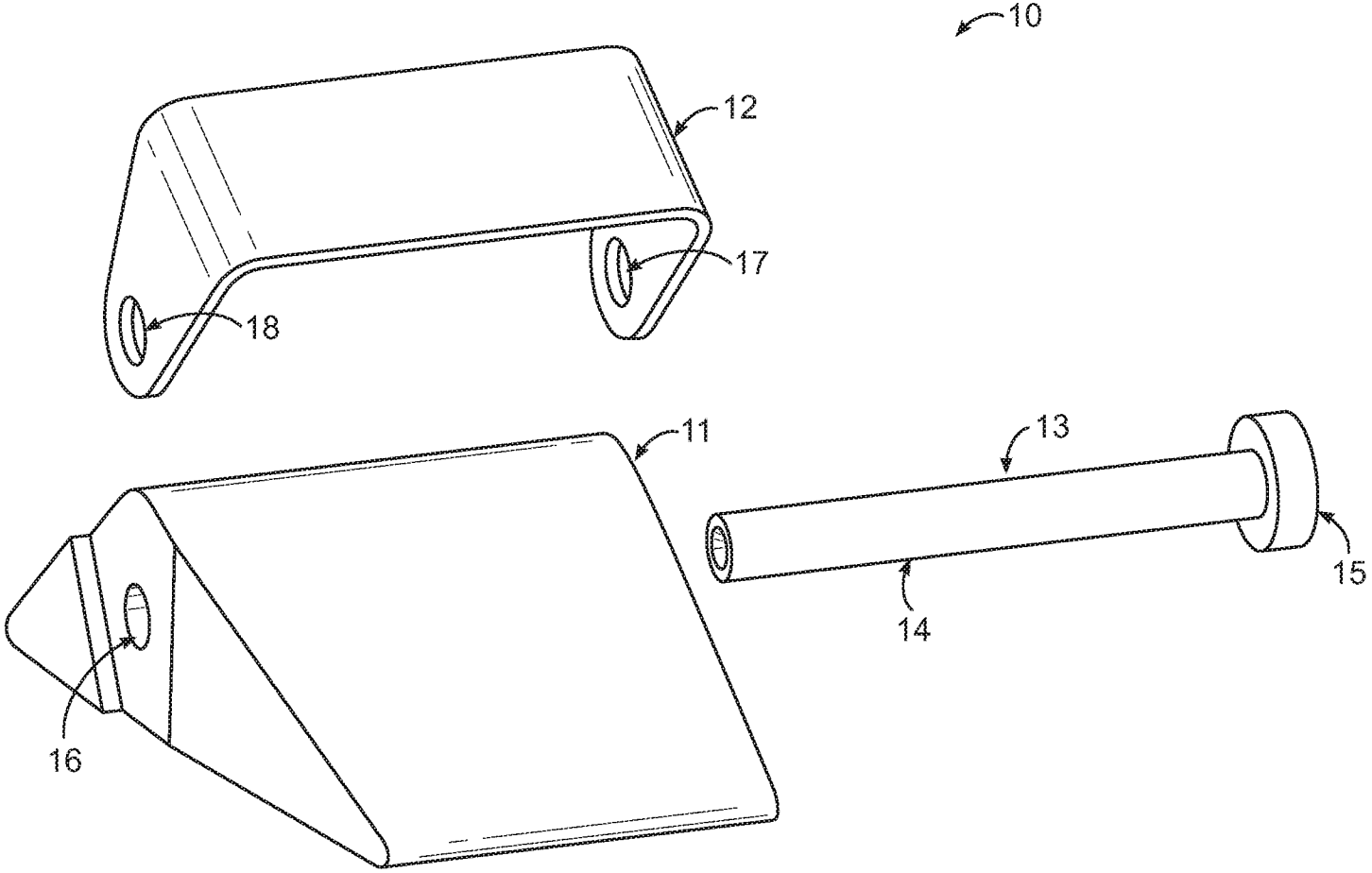
FIG. 1 is an exploded perspective view of the wedge in place, showing the wedge pad, bridge strap and wedge pin.
Figure 2:
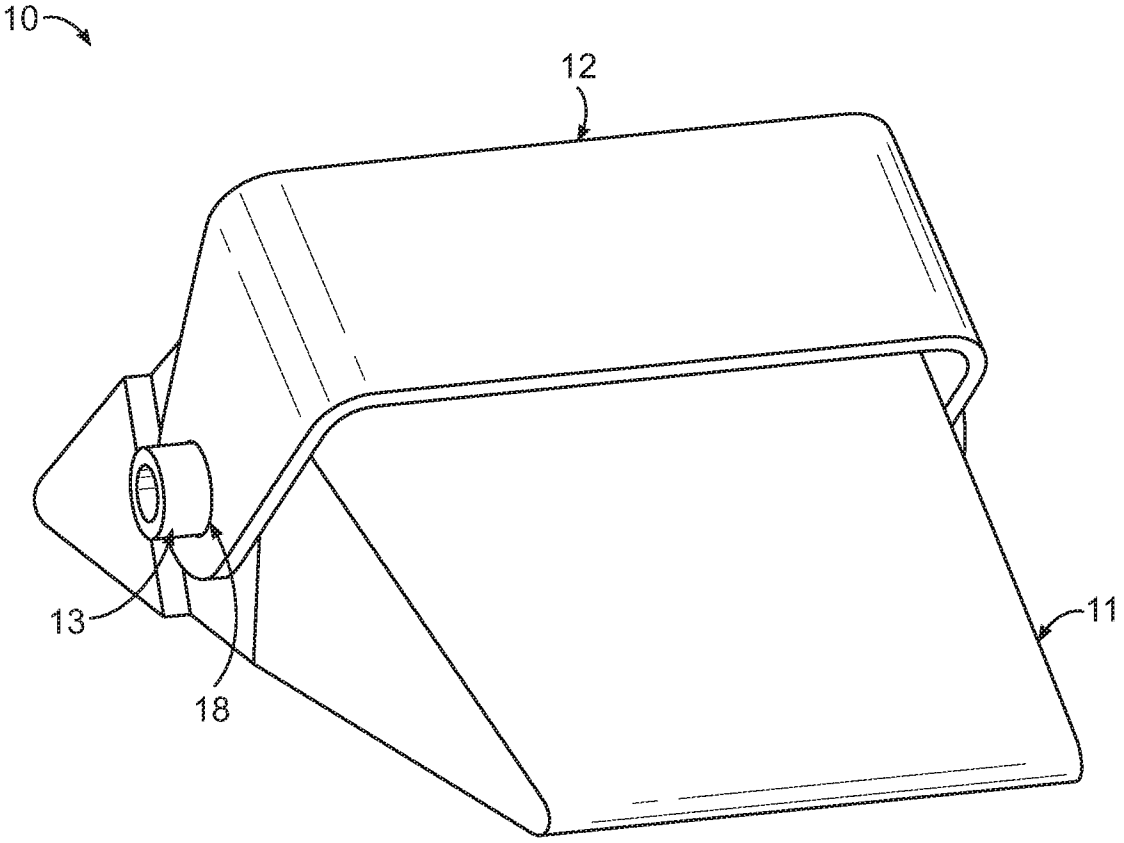
FIG. 2 is a perspective view of the wedge in place in an assembled configuration.

Referring now to the drawing figures, wherein like part numbers refer to like elements throughout the several views, there is shown in FIGS. 1-2, a wedge in place 10 (hereinafter, the "device") in accordance with a first embodiment of the present invention. The device 10 comprises a wedge pad 11, a bridge strap 12 and a wedge pin 13.

The wedge pad 11 preferably comprises a hypoallergenic rubber with a durometer of 20-60 Shore A. The wedge pad 11 more preferably comprises a hypoallergenic rubber with a durometer of 30-50 Shore A. The wedge pad 11 most preferably comprises a hypoallergenic rubber with a durometer of 35-45 Shore A. In some embodiments, the wedge pad 11 comprises a material with a durometer of 35-45 Shore A.

The bridge strap 12 is configured to selectively attach the wedge pad 11 to a wristband. The bridge strap 12 shown in the FIGs. is exemplary in nature and could be embellished in some embodiments by, for example, changing the shape of the bridge strap and/or adding surface features to the bridge strap (i.e., carving or bedazzling).

The wedge pin 13 can be configured with an elongate portion 14 and a head portion 15. The wedge pin 13 is preferably sized so that the diameter of the elongate portion 14 is less than the diameter of openings 17 and 18 on the bridge strap 12 so that the wedge pin 13 easily passes through the openings 17 and 18 to secure the bridge strap 12. The wedge pad 11 preferably contains an elongate opening 16 sized to provide a slight interference fit with the elongate portion 14 of the wedge pin 13. The head portion 15 of the wedge pin 13 is preferably a larger diameter than the diameter of the elongate opening 16. In embodiments where the wedge pad 11 comprises a rubber and the elongate opening 16 is sized to provide a slight interference fit, the wedge pin 13 can be inserted in the elongate opening 16 to secure the bridge strap 12 without the use of a fastener on the distal end of the elongate portion 14 from the head portion 15. The wedge pin 13 can comprise any suitable material, such as, for example, metal, plastic or any other polymer-based material.

In FIG. 2, the device 10 is assembled but not installed on a watch. The wedge pin 13 and bridge strap 12 have been installed so that the wedge pin 13 passes through the openings 17 and 18 (opening 17 is not visible in FIG. 2) and the elongate opening 16 (not visible in FIG. 2).

Figure 4:
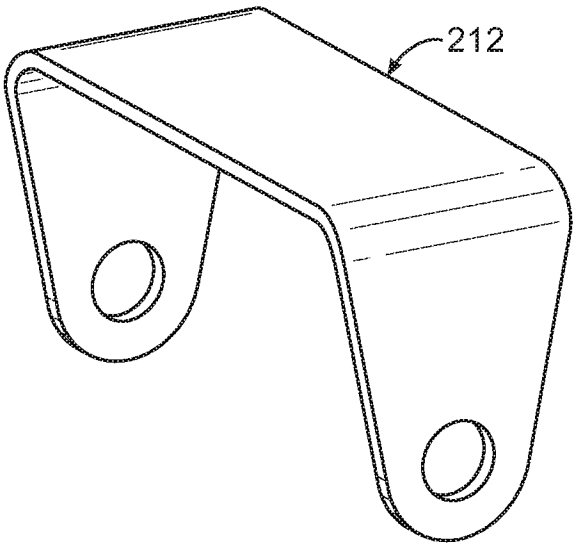
FIG. 4 is a perspective view of another exemplary embodiment of a bridge strap.
Figure 3:
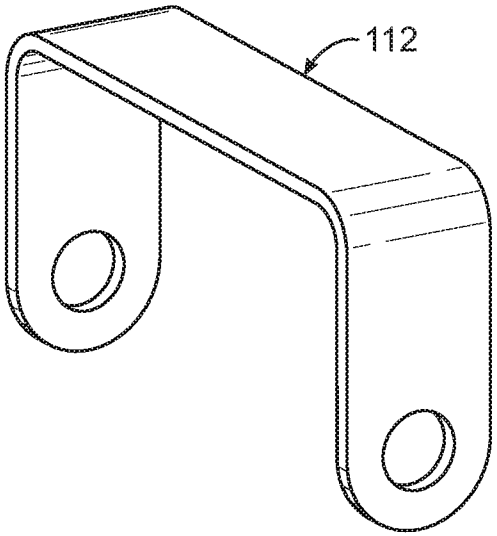
FIG. 3 is a perspective view of an exemplary embodiment of a bridge strap.

In FIGS. 3 and 4 are alternative embodiments of a bridge strap that can be used on the device 10 or on other variations of the device. In FIG. 3 is alternative bridge strap 112 with a generally narrow strap design that is generally even in width from the vertical portions to the horizontal portion. The terms vertical and horizontal, as used in reference to the figures is exemplary in nature and only relevant to the particular figure described.

The device 10 is intended for wear on a person's limb so that no portion of the device would remain vertical or horizontal in use. In FIG. 4 is another alternative bridge strap 212 with a generally wider strap design that is generally wider in its horizontal portion and tapers in its vertical portion. The embodiments in FIGS. 3 and 4 can comprise one or more materials, including, for example, metal, plastic and or a polymer-based material.

In some embodiments, the bridge strap 12 can comprise a flexible link between the sides of the wedge pad 11, using a fastening means to selectively fix portions of the bridge strap 12 to the wedge pad 11.

Figure 6:
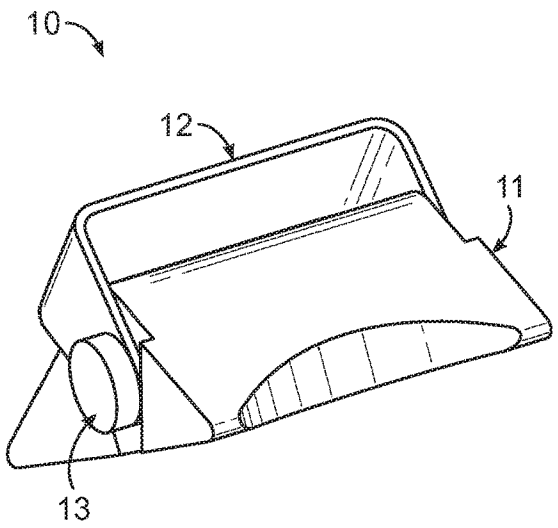
FIG. 6 is an alternative perspective view of the wedge in place in an assembled configuration.
Figure 5:
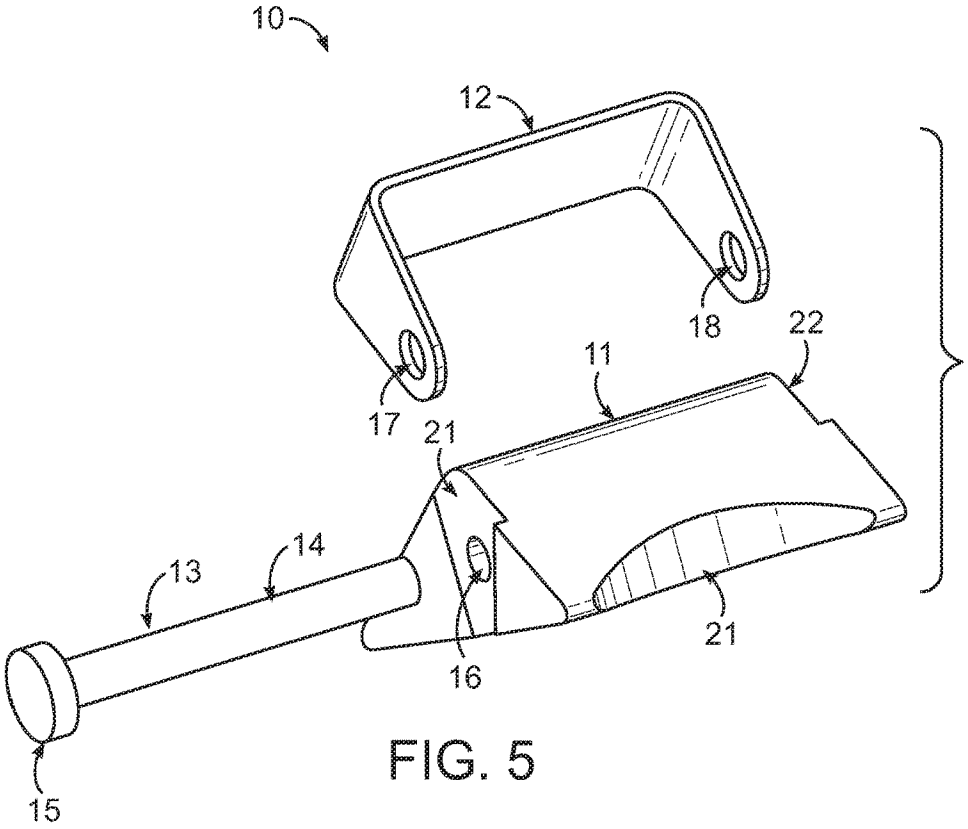
FIG. 5 is an alternative exploded perspective view of the wedge in place, showing the wedge pad, bridge strap and wedge pin.

In FIGS. 5 and 6 are alternative perspective views of the device 10. FIG. 5 is an exploded perspective view showing the other side of the wedge pad 11 compared to FIG. 1. In some embodiments, one end of the wedge pad 11 further comprises a scalloped area 21. In some embodiments, the sides of the wedge pad 11 further comprise cut-outs 21 and 22 that allow the bridge strap 12 to sit approximately flush with the sides of the wedge pad 11 when installed. FIG. 6 is an assembled view of the device 11 without being attached to a watch or wristband.

Figure 7:
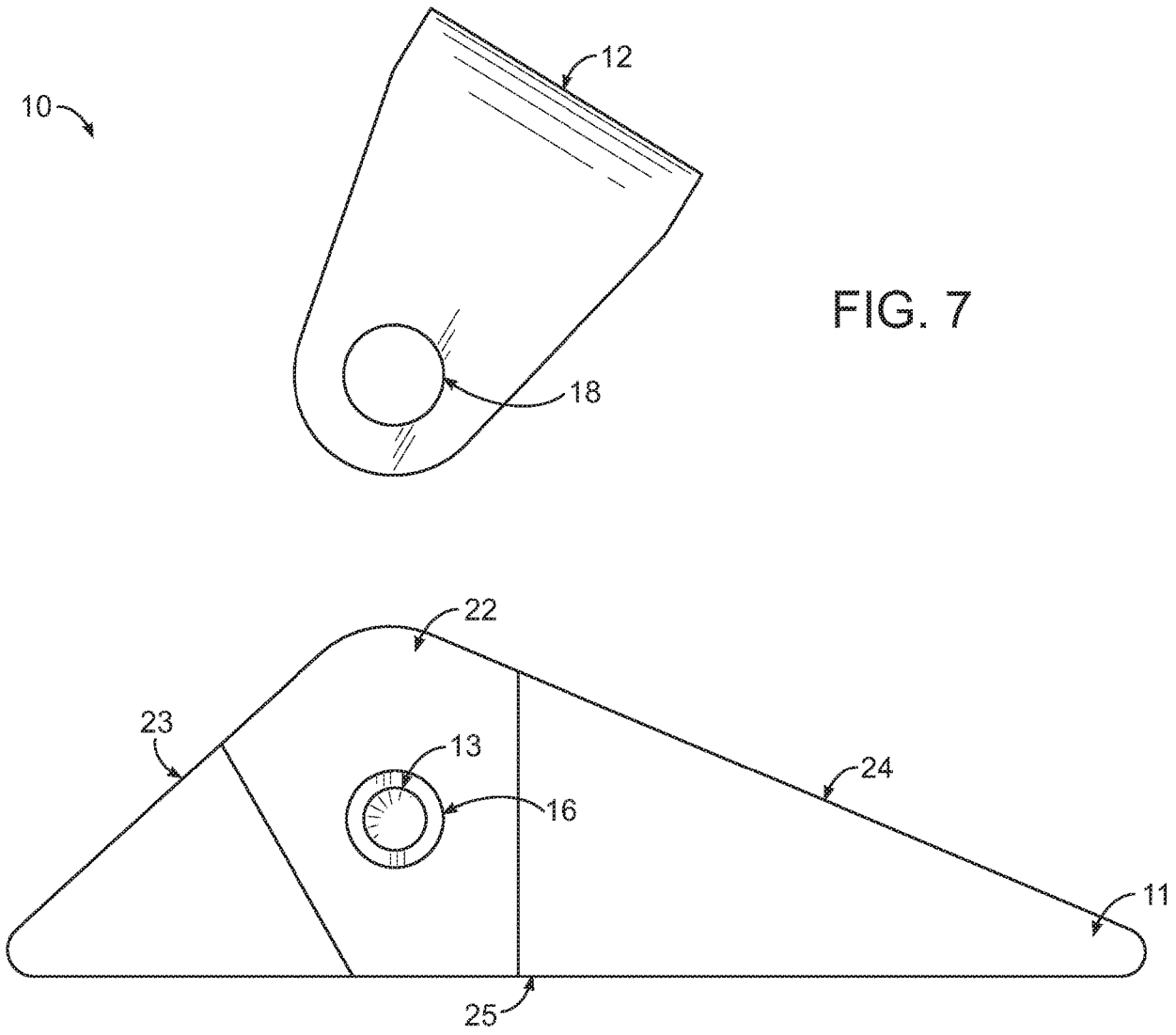
FIG. 7 is a side view of the wedge in place with the bridge strap removed.

In FIG. 7 is a side view of the device 10 showing the preferable asymmetrical wedge-shaped profile of the wedge pad 11. The wedge pad 11 preferably has a generally flat bottom 25 and two angled upper faces 23 and 24. One angled face 23 is ideally more steeply angled than the other angled face 24. In some embodiments, the angled face 23 has an angle between its upper face and the generally flat bottom 25 of about 30-60 degrees. In some embodiments, the angled face 23 has an angle between its upper face and the generally flat bottom 25 of about 35-50 degrees. In some embodiments, the angled face 23 has an angle between its upper face and the generally flat bottom 25 of about 40-45 degrees. In some embodiments, the angled face 24 has an angle between its upper face and the generally flat bottom 25 of about 10-40 degrees. In some embodiments, the angled face 24 has an angle between its upper face and the generally flat bottom of about 15-35 degrees. In some embodiments, the angled face 24 has an angle between its upper face and the generally flat bottom 25 of about 20-30 degrees. In embodiments where the angled face 23 has a steeper angle than the angle of angled face 24 relative to the generally flat bottom 25, it is preferable to face the angled face 23 towards the back of the upper portion of the watch, preferable to face the angled face 23 towards the wristband and preferable to face the generally flat bottom 25 towards the user's wrist.

Figure 8:
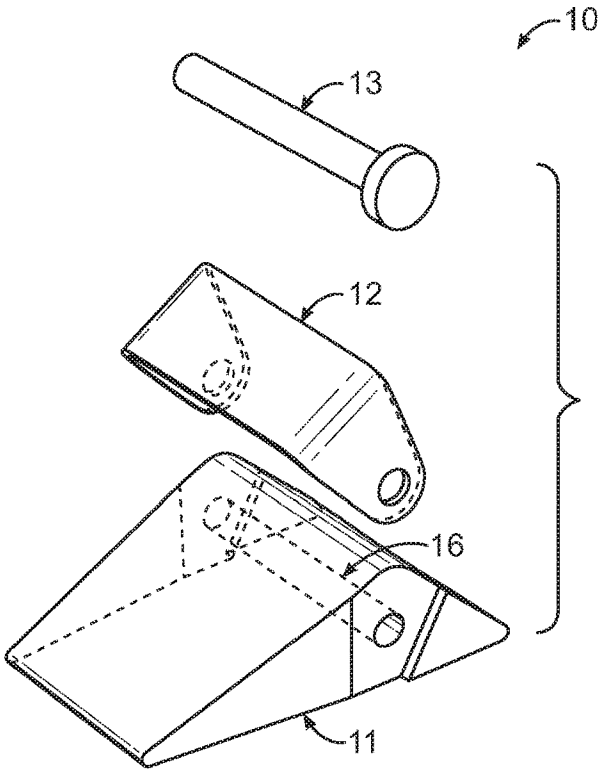
FIG. 8 is an alternative exploded perspective view of the wedge in place with dashed lines showing hidden features.

FIG. 8 is an alternative perspective view of the device 10 where hidden features are shown in dashed lines. The orientation of the elongate opening 16 in the wedge pad 11 is visible in FIG. 8.

Figure 9:
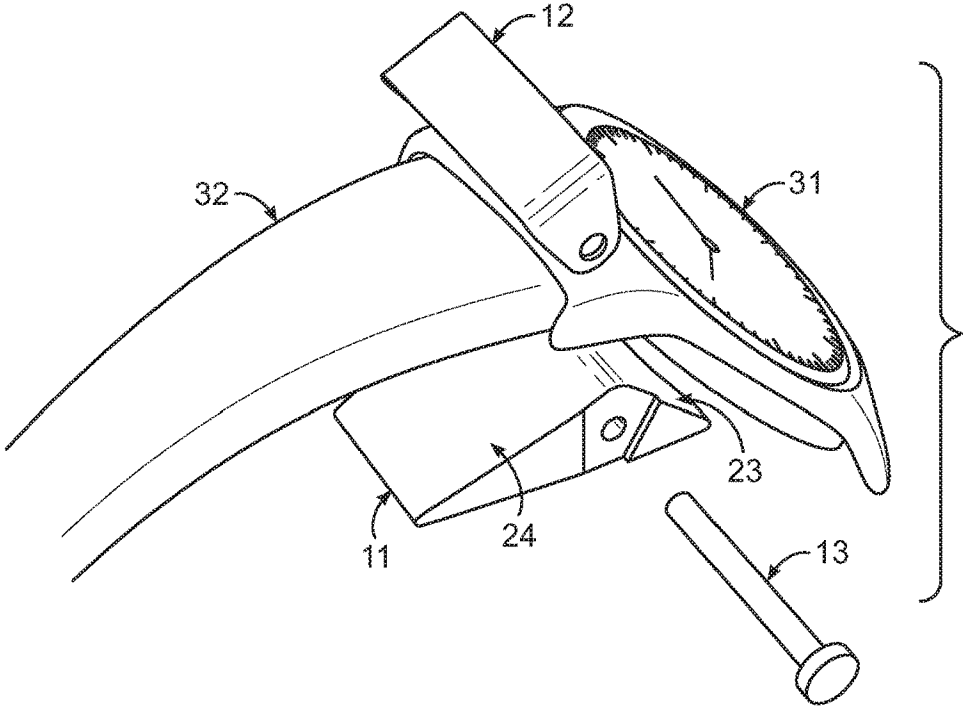
FIG. 9 is an exploded perspective view of the wedge in place in a configuration for installation on a watch.

FIG. 9 is a perspective exploded view of the device 10 configured to be installed on a watch 31 and wristband 32. In some embodiments, the more steeply angled face 23 is oriented towards the back of the watch 31 and the more gently angled face 24 is oriented towards the wristband 32 to best fill the gap between a watch 31 and wristband 32 and a wearer's limb. The device 10 in FIG. 9 is being installed on the top end of the watch 31 to also increase the angle of the watch face relative to the user's face. In some instances, it may be desirable to install the device 10 in other locations, however, most watches will be more easily viewed by a user when the device 10 is placed under the junction between the watch 31 and the wristband 32 at the top of the watch 31. As used herein, the top of a watch refers to the 12 o'clock end of a watch or the top of a display when referring to a smart watch.

Figure 10:
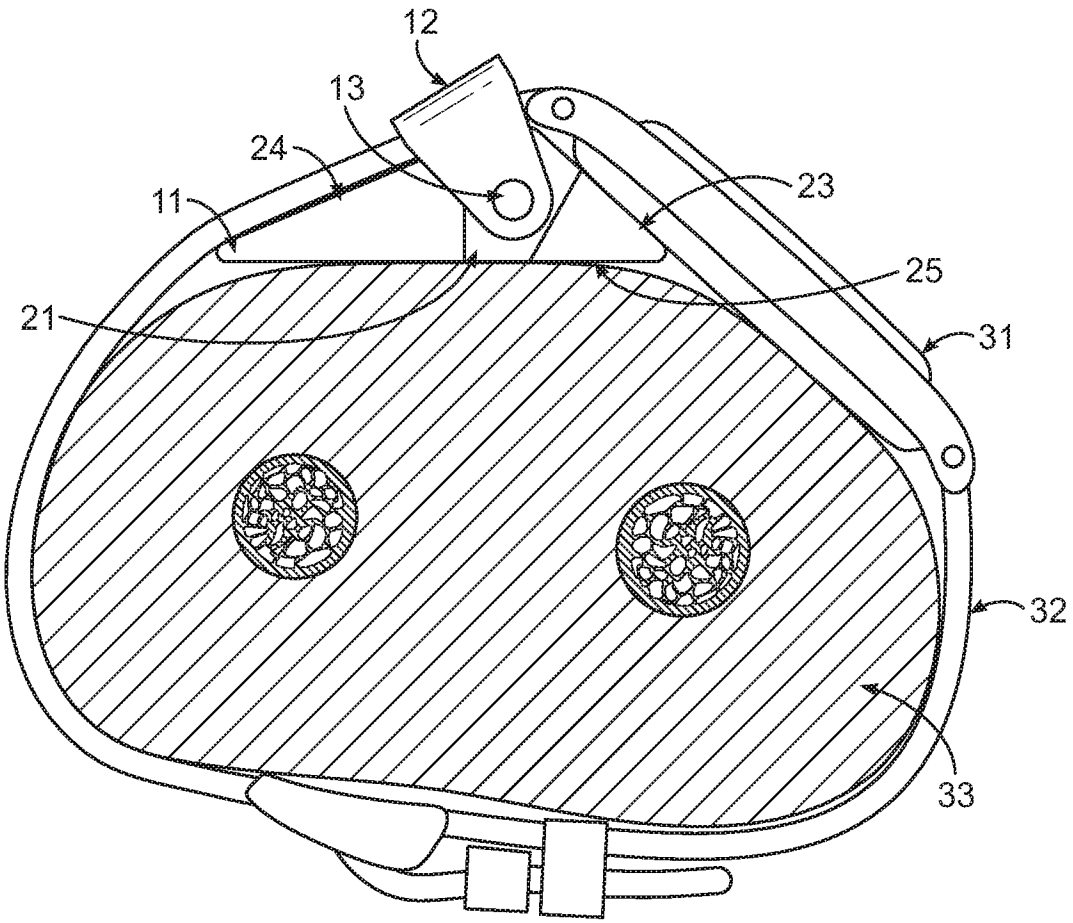
FIG. 10 is a side view of a wedge in place installed on a watch on a sectioned wrist.

In FIG. 10 is side view of the device 10 installed on a watch 31 and wristband 32 attached to a (sectioned) person's wrist 33. Similar to FIG. 9, in some embodiments, the more steeply angled face 23 is oriented towards the back of the watch 31 and the more gently angled face 23 is oriented towards the wristband 32 to best fill the gap between the watch 31, wristband 32 and the person's wrist 33. The generally flat bottom 25 of the wedge pad 11 is oriented towards the person's wrist 33. In some embodiments, the wedge pad 11 comprises a material with a durometer of less than 50 Shore A and can conform when worn on a person's wrist to the space between a person's wrist and a watch and/or wristband so that the angles of the faces 23 and 24 are not necessarily fixed in use. In FIG. 10, the device 10 also pushes the top of the watch 32 away from the person's wrist 33, changing the angle of the watch 32 relative to the person's wrist 33 to a more desirable viewing angle.

What has been described is a selectively attachable watch accessory for filling the gap between a watch and/or wristband and a wearer's wrist. The watch accessory also keeps a watch from rotating or sliding along a wearer's wrist without making the wristband unusually tight and also can change the angle of the watch display. In this disclosure, there are shown and described only the preferred embodiments of the invention, but, as aforementioned, it is to be understood that the invention is capable of use in various other combinations and environments and is capable of changes or modifications within the scope of the inventive concept as expressed herein.

What is claimed is:

1. A watch accessory, comprising:

a wedge pad selectively fixed between a watch and wristband and a wearer's wrist;

a bridge strap configured to attach the wedge pad to one of the watch or wristband; and a wedge pin configured to selectively attach the bridge strap to the wedge pad;

wherein:

the wedge pad is configured to fill a gap between the watch and wristband and the wearer's wrist.

2. The watch accessory of claim 1 wherein the wedge pad further comprises a volume with a triangular side profile.

3. The watch accessory of claim 2 wherein the triangular side profile of the wedge pad further comprises a substantially flat bottom, a first upper surface and a second upper surface.

4. The watch accessory of claim 3 wherein the wedge pad further comprises a first angle between the substantially flat bottom and the first upper surface, a second angle between the substantially flat bottom and the second upper surface and wherein the first angle is greater than the second angle.

5. The watch accessory of claim 4 wherein the first angle comprises about 30-60 degrees.

6. The watch accessory of claim 4 wherein the first angle comprises about 40-45 degrees.

7. The watch accessory of claim 4 wherein the second angle comprises about 10-40 degrees.

8. The watch accessory of claim 4 wherein the second angle comprises about 20-30 degrees.

9. The watch accessory of claim 2 wherein the wedge pad further comprises a rubber with a durometer of 30-60 Shore A.

10. The watch accessory of claim 2 wherein the wedge pad further comprises a rubber with a durometer of 35-45 Shore A.

11. The watch accessory of claim 4 wherein the wedge pad further comprises sides with a substantially flat portion.

12. The watch accessory of claim 11 wherein the sides of the wedge pad further comprise a recessed portion.

13. The watch accessory of claim 12 wherein the wedge pad further comprises an elongate opening extending between the sides of the wedge pad.

14. The watch accessory of claim 13 wherein the elongate opening comprises a first diameter, wherein the wedge pin comprises a second diameter and wherein the second diameter is greater than the first diameter.

15. The watch accessory of claim 14 wherein the bridge strap further comprises a linking means between the sides of the wedge pad.

16. The watch accessory of claim 15 wherein the bridge strap further comprises a plurality of openings with a third diameter, wherein the third diameter is greater than the second diameter.

17. The watch accessory of claim 1 wherein the wedge pad is configured to provide a nonslip surface and prevent the watch from rotation or displacement relative to the wearer's wrist.

18. The watch accessory of claim 17 wherein the wedge pad is configured to enhance the fit of the watch and wristband relative to the wearer's wrist by filling in the gap.

* * * * *